United States Patent [19]

Allen

[11] Patent Number: 4,991,314

[45] Date of Patent: Feb. 12, 1991

[54] FLUID FLOW APPARATUS AND PROCESS

[75] Inventor: Donavan J. Allen, Taylors, S.C.

[73] Assignee: Torus Corporation, Greenville, S.C.

[21] Appl. No.: 338,489

[22] Filed: Apr. 13, 1989

Related U.S. Application Data

[63] Continuation of Ser. No. 157,053, Feb. 16, 1988, abandoned, which is a continuation-in-part of Ser. No. 124,051, Nov. 23, 1987, Pat. No. 4,836,702.

[51] Int. Cl.[5] ..... A45D 20/12

[52] U.S. Cl. ..... 34/98; 34/97; 239/558

[58] Field of Search ..... 34/97, 98, 96; 239/558, 239/543, 567

[56] References Cited

U.S. PATENT DOCUMENTS

| | | | |
|---|---|---|---|
| 1,942,905 | 1/1934 | Semkow | 128/66 X |
| 1,948,807 | 2/1934 | Taylor | 239/543 |
| 2,306,100 | 12/1942 | Williams | 34/97 |
| 2,856,700 | 10/1958 | Wales | 34/91 |
| 3,373,740 | 3/1968 | Riepl | 128/66 |
| 3,717,936 | 2/1973 | Tolmie et al. | 34/98 X |
| 3,861,060 | 1/1975 | McNair | 34/97 |
| 4,836,702 | 6/1989 | Allen | 401/10 |

FOREIGN PATENT DOCUMENTS

| | | | |
|---|---|---|---|
| 950020 | 10/1956 | Fed. Rep. of Germany | 34/97 |
| 924139 | 4/1963 | United Kingdom | 34/97 |

*Primary Examiner*—Randall L. Green
*Assistant Examiner*—David H. Willse
*Attorney, Agent, or Firm*—Dority & Manning

[57] ABSTRACT

An apparatus and process for impinging a fluid upon an object to be treated. A generally conical shaped flow of fluid is directed from a body which has an opening at the base of the cone against an object to be treated, and located so that fluid impinging on the object reflects upwardly therefrom in the direction of the opening and has a lifting effect on filamentary material, such as hair, located on the object.

9 Claims, 3 Drawing Sheets

FLUID FLOW APPARATUS AND PROCESS

This application is a continuation of application Ser. No. 157,053 filed Feb. 16, 1988 now abandoned, which is a continuation-in-part of Allen, U.S. Ser. No. 07/124,051, filed Nov. 23, 1987 now U.S. Pat. No. 4,836,702

BACKGROUND OF THE INVENTION

This invention relates generally to the art of devices which impinge a fluid upon an object and, more particularly, to the art of fluid dynamics in the areas of washing and drying.

There are numerous examples and applications of a fluid moving when under pressure. Attention is directed particularly toward cases in which a fluid is impinged upon an object to be treated. Such cases would include the use of a garden hose to, for example, water flowers or wash a variety of items, the use of a vacuum cleaner, hair dryer and fluid contact generally. In most such cases, there is a specific application of the principles of fluid flow dynamics and, typically, a singular purpose or outcome is effected.

For example, fluid flow dynamics include the principle of focused or swirling action, whereby a mass of fluid has a circular motion which tends to form a cavity or vacuum in the center of the circle, drawing towards this cavity or vacuum matter subject to its action. This principle of vortexes (or vortices) has been utilized in vacuum cleaning equipment to effect solid/gas separation.

Various specialized devices have existed within the prior art as applications of the dynamics of fluid flow to solve a variety of problems. One example is a hair cutting apparatus disclosed in U. S. Pat. No. 3,900,949 to Anzalone wherein a hollow open-ended enclosure includes air movement means for drawing a subject's hair away from the scalp and into the open end of the enclosure, wherein a cutter effects severance of the drawn hair. The air movement means simultaneously removes the hair clippings.

In U. S. Pat. No. 3,529,724 to Macluda, et al., a device is disclosed which separates solid contaminant particles from a fluid medium. Fluid is forced into a cylindrical enclosure and caused to flow in an outer circuitous path. Fluid migrates from this outer circuitous path towards the interior where it is withdrawn through a central opening, leaving heavier elements to the outside while clean fluid passes to the interior and out of the device.

U. S. Pat. No. 3,475,828 to Fledman discloses a process and apparatus for drying and finishing a washed fabric article having at least 65% polyester fibers. Steam and hot air are blown into a freely suspended article, followed by hot air alone to return the article to a state wherein ironing is not required.

In U. S. Pat. No. 3,003,346 to Morris, et al., a laundry machine with a hydraulic separator is disclosed wherein undesirable foreign particles are removed from the laundering fluid by a system which uses a conically-shaped separating chamber.

With regard to hair drying, it is readily seen that fluid flow dynamics are basic to effective hair drying equipment. Generally, heated air is forced from various embodiments of a heater/blower assembly onto wet hair to dry it. The direct force of the blown air can be problematic, however, since it tends to mat down the hair, causing a barrier so that the forced air is unable to penetrate efficiently to the base of the hair. In such cases, unless one hand is used to lift and separate the hair, the drying process is prolonged. Obtaining dry hair in the shortest period of time is desirable for several reasons, principal among them being that the application of heat to the hair tends to cause the hair ends to become brittle and split, leaving the hair less manageable and less attractive. In addition, the prolonged application of heat may cause scalp and facial discomfort and the relaxing of permanent wave curls.

In U.S. Pat. No. 2,392,405 to Phipps, a hair drying process is disclosed which provides for the continuous use of air from which a large part of the moisture content has been removed by refrigerating and reheating it. U.S. Pat. No. 1,541,988 to Meyer discloses a method and means for drying the hair and scalp which involves projecting radiant heat and radiant light with the steam or blast of air upon the hair or scalp to stimulate circulation sufficiently to counteract the chilling effect of the air accompanying evaporation and absorption of the moisture from the hair.

In addition to hair drying equipment, fluid flow dynamics are basic to cleaning devices which use a cleaning fluid. In particular, the cleaning of paint brushes and paint rollers is a consideration.

There is a widespread use of paint brushes and paint rollers for applying paint to surfaces. Through use, however, the brush or roller becomes totally saturated and paint is forced deep within bristles to become trapped at the handle, or penetrates the roller mat to remain at its core. Current methods of cleaning, to a greater or lesser extent, allow residue to remain in the applicator. When dry, the residual paint and/or other deposits inhibit effective use of the brush or roller and cause the item to be untimely discarded. With effective cleaning, however, the life of the applicator may be significantly extended.

Complicating the cleaning process is the consideration that rollers vary in diameter and a cleaning apparatus having an interference fit with one roller may not suitably engage another roller. Additionally, liquid under pressure must be applied at an appropriate angle to the roller to avoid causing the mat of the roller to compress, inhibiting penetration of the liquid into the mat. Further, the inevitable splashing caused by liquid under pressure must be offset. However, to shield the user inevitably inhibits the user's ability to monitor the cleaning process. Periodically, then, the process must be interrupted so that the user can evaluate progress which causes inconvenience and takes additional time.

Various cleaning devices for paint applicators and methods for their user have existed within the prior art. U. S. Pat. No. 4,606,777 to Brow discloses an apparatus for cleaning a paint roller comprising an annular sleeve adapted to have an interference fit with the pad of the roller. A similar device is disclosed in U.S. Pat. No. 4,517,699 to Petricks which further includes scrubber elements positioned along the inner surface of the annular sleeve.

In U.S. Pat. No. 4,126,484 to Monteiro, an elongated, hollow, cylindrical body is disclosed which slidability receives the roller in close tolerance. Cylindrical casings for roller-type applicators are also disclosed in U.S. Pat. No. 4,377,175 to Fritz and U.S. Pat. No. 4,155,230 to Lacher. U.S. Pat. No. 2,985,178 to Christensen provides an annular tube with orifices which are tangentially directed against the surface of a roller, causing it to spin or rotate. An axially extending shield arranged about the annular tube to protect the user is included in the disclosure. Other related disclosures include U.S. Pat. No. 3,577,280 to George and U.S. Pat. No. 3,421,527 to Dettman.

Thus, various specific applications of impinging a fluid upon an object to be treated exist in the prior art, each tending to have a singular purpose. There does not exist, however, a general application of principles of fluid flow dynamics having diverse purposes and effecting multiple outcomes.

SUMMARY OF THE INVENTION

It is thus an object of this invention to provide a novel apparatus for impinging a fluid upon an object to be treated.

It is a further object of this invention to provide a novel process for impinging a fluid upon an object to be treated which employs either turbulent scrubbing action or turbulent drying action.

It is a more particular object of this invention to provide a novel apparatus and process for efficient and thorough cleaning of paint applicators.

It is a further particular object of this invention to provide a novel apparatus and process for cleaning paint applicators which allows the progress of the cleaning process to be continuously and conveniently monitored.

It is an additional particular object of this invention to provide a novel apparatus and process for drying hair without matting it down or relaxing permanent wave curls.

It is an additional particular object of this invention to provide a novel apparatus and process for drying the hair rapidly while requiring the use of only one hand, and for minimizing heat-related facial and scalp discomfort.

These, as well as other objects, are accomplished by an apparatus which impinges a fluid upon an object to be treated, the apparatus comprising a circular, toroidal tube having an outer surface, an inner surface and a plurality of surface faces, and which defines an annular fluid passage means within the toroidal tube between its inner and outer surfaces, a straight connecting tube defining a fluid entry means for connecting perpendicularly to the fluid passage means, fluid outlet means disposed in a circular array and formed in one face of the toroidal tube about the inner surface at a specified angle with respect to a stated reference line positioned within the toroidal tube and communicating with the fluid passage means, and a source of forced fluid, or fluid under pressure, the fluid exiting from the toroidal tube through the outlet means forming a conical array of jet streams which converges to a point on the toroidal axis. The process of this invention is carried out by creating a focused flow of fluid in a predetermined direction and simply placing an object between the focal point of the focused flow and the source of the focused flow for treatment by the fluid therein.

DETAILED DESCRIPTION OF THE DRAWINGS

Figure 1:
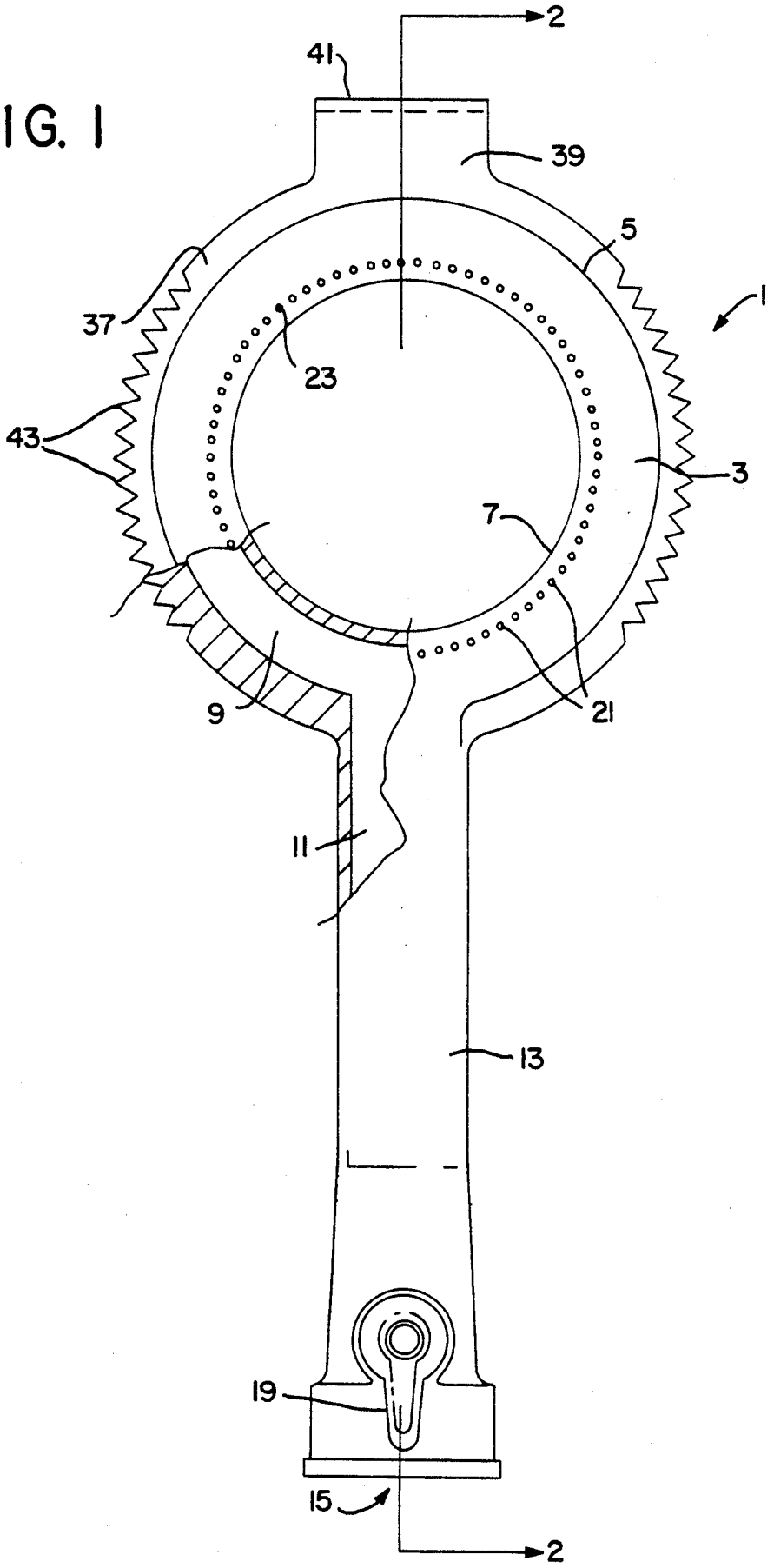
FIG. 1 of the drawings is a bottom view of one preferred embodiment (cleaning device for paint applicators) of the apparatus in accordance with this invention showing the overall arrangement of the parts of the device and includes sectional views of the toroidal tube and straight connecting tube showing the fluid passage means connecting with the fluid entry means.

In accordance with this invention, it has been found that an apparatus which impinges a fluid upon an object to be treated described herein represents a single application for effecting multiple and diverse purposes. Such purposes include liquid contact such as in laundering, mixing, dying and gaseous contacts such as drying. The apparatus in one preferred form is adapted for use with a cleaning fluid. This apparatus of this invention efficiently and thoroughly cleans items formed of or covered with bristles, hair, fur or similar nappy fibrous material, both woven and non-woven. In particular, this preferred form of the apparatus of this invention cleans paint brushes and rollers, significantly extending the life and performance of these items.

Jet streams, emitted through a plurality of orifices positioned in a circular array on the apparatus, lift, separate and otherwise manipulate the contacted material, providing a scrubbing action to accomplish thorough cleaning. This scrubbing action when used on paint brushes and rollers cleans below surfaces allowing the liquid to penetrate the brush bristles to their origin at the handle and the roller mat to its core for deep-cleaning results.

In one preferred embodiment of the device of the instant invention, the cleaning process is effectively and conveniently monitored as it proceeds. Areas of the brush or roller needing further attention are readily identified and the overall process is rapidly expedited. User of the device of the instant invention provides an easy and quick way to clean paint brushes and rollers, reducing the mess and frustration typically associated with this task.

The following description is of the fluid mechanics and resulting effects thereof associated with the apparatus of the instant invention, whose embodiment is a cleaning device for paint applicators:

Upon connection to a pressurized water source such as a residential yard spigot and hose, and upon opening of the ball valve, the torus and connecting straight tube fill with water at inlet pressure. The static pressure of the contained water is converted to velocity pressure at the orifice discharge openings, and the velocity of the issuing jets is determined by Torricelli's theorem.

Due to the geometry of the array of orifices with respect to that of the torus, the issuing jets form a hollow right circular cone of spray, the base of the cone being of the same diameter as that of the orifice array, and the conical axis coinciding with the toroidal axis, i.e., perpendicular to the principal face of the torus tube. The individual water jets coincide at a point being the apex of the cone, on the toroidal axis; in other words, the jets are focused symmetrically to a point.

When the apparatus is applied to a cleaning operation, it is held with the principal face parallel to the surface to be cleaned (herein referred to as the "target surface"), hence the conical spray axis is perpendicular to the target surface. The distance separating the work surface and the toroid is less than the height of the spray cone which would develop in free flow; therefore, the jets impinge on a circular ring of the target surface area short of the point of focus.

Hence, each individual jet has a component of momentum perpendicular to the target surface and a component parallel to it as well. When viewed from the base of the spray cone, each parallel component of momentum is directed towards the center or the axial point of focus. As an individual jet strikes the target surface, it is reflected backward toward the torus and at the same time inwardly toward the concial axis. As a result, the reflected jets all converge toward the conical axis. .Geometrically, the shape of the flow is that of a hollow right circular cone, truncated at the area of impact with the target surface, and with the truncated conical tip being reversed in direction so as to point back along the concial axis toward the principal face of the torus (perpendicular to and away from the target surface).

There are three main effects produced by the converging jets as they impact and reflect off of the target surface. First, the bristles, hairs or individual strands of target media become entrained in the liquid jets and are forced to lift away from ("stand up" upon) the target surfaces. This exposes the roots and base of the media to being wetted by the washing liquid. Rather than being compressed by liquid impact into a tangled dense mat, the target media strands tend to be isolated and lifted upright from the target surface to which they are connected, greatly increasing the strands' exposure to wetting.

Second, by the same effect, the roots and base of the media are exposed to the kinetic energy of the jets, allowing particules of paint, dirt and other deposits to be dislodged and flushed away by the reflected jet streams.

Third, a considerable amount of fluid turbulence is created as the jets are reflected and interact dynamically with the strands of uplifted target media. Particularly as the toroid is moved in an oscillatory manner parallel to the target surface and coupled with a slight reciprocating motion along the conical spray axis perpendicular to the target surface, the intensity and patterns of turbulence vary considerably. This causes a great "scrubbing action". The strands of media are forced into a waving or swaying motion as they continue to stand upright in the reflected liquid stream, and this enhances the cleaning action by further dislodging particulate matter from the media strands.

The overall effects of the fluid mechanics peculiar to this device are to physically lift entrained solids away from the media to be cleaned, from the base of the fibers outward, by direct transfer of momentum; to separate tangles and eliminate matting of the media which occurs in other types of cleaning methods; to thoroughly wet, clean and rinse the entire length of the media through the induced turbulence and reflected flow characteristic of the jet pattern; to accomplish the cleaning operation very efficiently, that is, through the expenditure of less time and consumption of water or cleansing liquid than is required in other methods.

In addition, a second preferred form of the apparatus of this invention is used with a conventional heater/-blower assembly to dry hair. The process of this invention employs a focused fluid-mechanical induced rotational effect which entrains, lifts from the scalp and separates the hair, the result being highly efficient turbulent drying action which reaches the base of the hair for rapid drying, requiring the use of only one hand. Drying is effected without matting down the hair, removing permanent wave curls or producing as much heat-related discomfort as perceived through the use of other types of dryers having the same wattage of heating elements.

The following description is of the fluid mechanics and resulting effects thereof associated with the stated preferred form of the apparatus of the instant invention:

Upon switching on a conventional heater/blower assembly, a flow of heated air is forced into the connecting straight tube and hence into the toroidal tube. The static pressure of the air in the torus is converted to velocity pressure at the discharge nozzle openings and the velocity of the issuing air jets is determined by Torricelli's theorem.

Due to the geometry of the array of discharge nozzle with respect to that of the torus, the issuing jets form a hollow right circular cone of primary airflow, the base of the cone being of the same diameter as that of the nozzle array, and the conical axis coinciding with the toroidal axis, i.e., perpendicular to the face of the torus tube. The individual air jets coincide at a point being the apex of the cone on the toroidal axis; in other words, the jets are focused symmetrically to a point. Within this disclosure, the term "focused flow" means a flow which is focused to a point or vertex and includes a straight conical flow and a swirling or a vortical flow which is focused.

When the device is applied to a hair drying operation, it is held with its toroidal face parallel to the scalp, hence the conical airflow axis is perpendicular to the user's scalp. The distance separating the scalp and the toroid is less than the height of the airflow cone which would develop in free flow; therefore, the jets impinge on a circular ring of the scalp area short of the point of focus.

Hence, each individual jet has a component of momentum perpendicular to the scalp surface and a component parallel to it as well. When viewed from the base of the airflow cone, each parallel component of momentum is directed towards the center or the axial point of focus. As an individual jet strikes the scalp surface, it is reflected backward toward the torus and at the same time inwardly toward the conical axis. As a result, the reflected jets all converge toward the conical axis. Geometrically, the shape of the flow is that of a hollow right circular cone, truncated at the area of impact with the scalp surface and with the truncated conical tip being reversed in direction so as to point back along the conical axis toward the face of the torus (perpendicular to and away from the scalp).

There are three main effects produced by the converging jets as they impact and reflect off of the scalp, which give rise to the efficiency and unique features of the drying process resulting from this device. First, the individual strands of wet hair become entrained in the converging airflow jets and, due to the reflection and inward turning motion of the airflow, are lifted away from (forced to "stand up" upon) the scalp. This exposes the roots and lower portions of the hair strands nearest the scalp to the drying airflow directly. Rather than being compressed by airstream impact into a tangled dense mat, the individual hair strands tend to be isolated and lifted upright from the scalp's surface. This action may eliminate the need for the user to use his or her second hand to manually lift the hair from the scalp with a comb or brush while holding the dryer with his or her first hand. It also contributes to this device's ability to dry hair without creating matted tangles or removing permanent wave curls.

Second, by virtue of the geometry of the airflow pattern as it converges and is then reflected off the scalp, the hair roots and the scalp are exposed to a diffused kinetic and thermal energy stream in comparison to that produced by conventional types of hair dryers. That is, the scalp area impacted by the airflow from this device, when held in a steady position, is greater than the corresponding scalp area impacted by the discharge from conventional dryers. Even though the thermal energy content of both streams is equal, the laws of heat transfer decree that, for a given time of exposure and due to the larger impacted surface area, the scalp temperature will be raised less with this device's airflow pattern than would occur if a conventional dryer, using the same total air flowrate and discharge temperature, were used. It has been found that this effect is quite noticeable to the user, and results in greater comfort and significantly less heat damage to the hair and scalp than possible with conventional dryers.

Third, a considerable amount of fluid turbulence is created as the airflow from this device is reflected from the scalp and interacts dynamically with the individual strands of uplifted hair. The turbulence is particularly enhanced as the toroid is moved in an oscillatory manner parallel to the target surface, and coupled with a slight reciprocating motion along the conical airflow axis perpendicular to the user's scalp; the intensity and patterns of turbulence vary considerably with this motion. The strands of hair are forced into a waving or swaying motion as they continue to stand upright in the reflected airstream, and this enhances the drying rate for a given fixed air flowrate and temperature. The drying of wet hair follows the same physical laws as in the drying of any solid material, i.e., the basic laws of heat and mass transfer. The time rate of drying is a function of temperature gradient, concentration (of moisture) gradient and turbulence. The demonstrated effects of this invention are surprising in that, in comparison to conventional types of hair dryers, given the same volumetric rate of airflow through the devices and the same electrical power consumption by the air heating elements, this invention removes the same amount of moisture from the same head of hair in less time, apparently due to the turbulence patterns created.

The overall effects of the fluid mechanics unique to this invention are to physically lift entrained strands of hair from the scalp by direct transfer of momentum; to separate tangles and eliminate matting of the hair which occurs with other types of existing conventional hair dryers; to thoroughly dry the entire length of the hair through the induced turbulence and reflected flow characteristic of the airflow pattern; to accomplish the drying operation very efficiently, i.e., through the expenditure of less time than is required in other methods; to accomplish the drying without removing permanent wave curls; to provide greater comfort to the user, who perceives lower scalp temperatures than with the user of conventional dryers, and to reduce the process to a single-handed rather than two-handed operation for the user.

The features and advantages detailed for both preferred embodiments of the instant invention, as well as others, will be apparent from the following description and reference to the figures of drawings.

Figure 2:
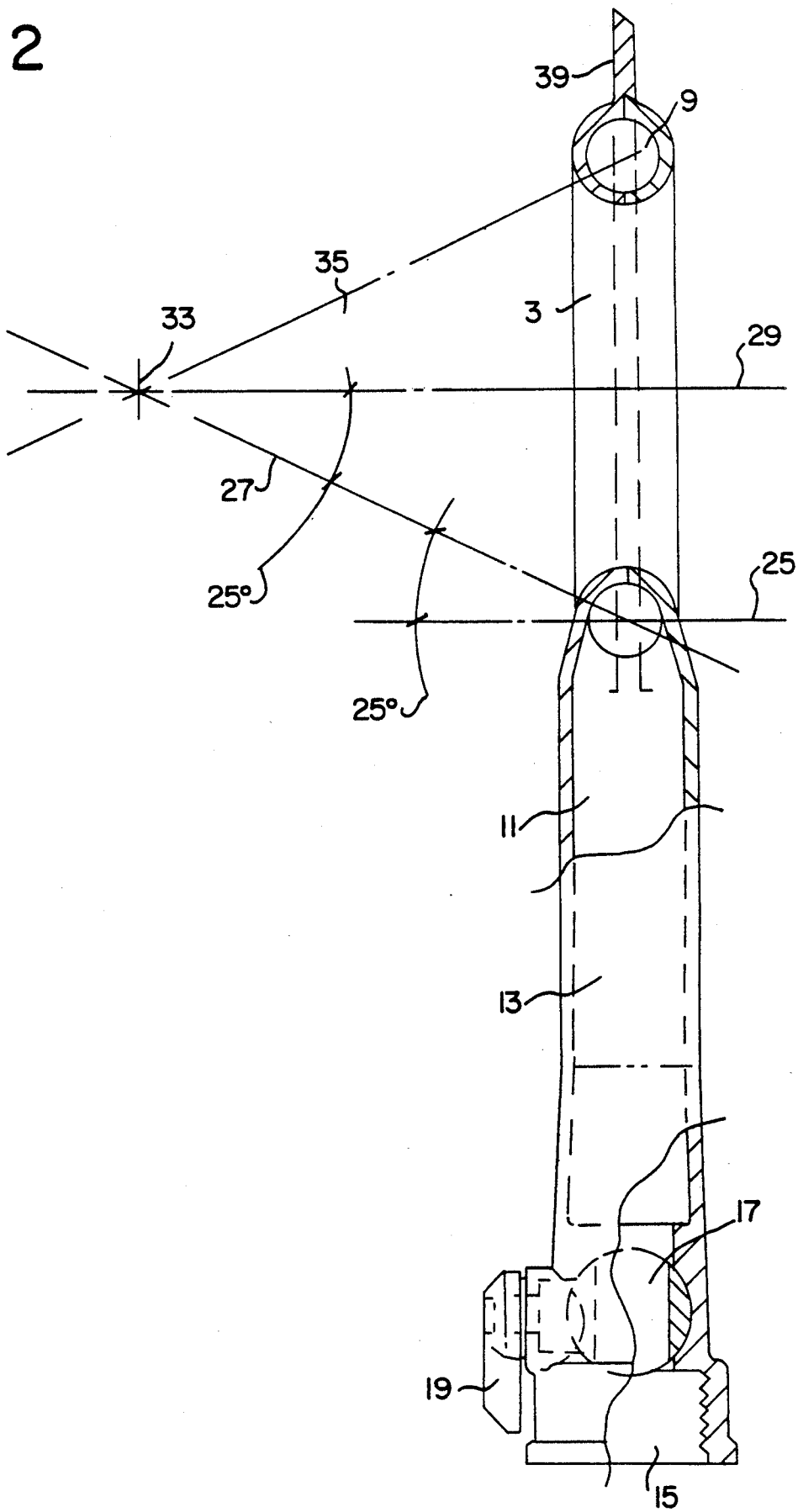
FIG. 2 of the drawings includes a side view of the straight connecting tube (handle) of the preferred embodiment of the apparatus in accordance with this invention shown in FIG. 1, a longitudinal sectional view of the straight connecting tube and a cross-sectional view of the toroidal tube about the line 2—2 of FIG. 1.

FIG. 1 of the drawings illustrates one preferred form 1 of the apparatus of the invention, a cleaning device for paint applicators. The device includes a circular toroidal tube 3 having an outer surface 5 and an inner surface 7 and defining an annular fluid passage means 9 between the inner and outer surfaces of toroidal tube 3. Annular fluid passage means 9 connects perpendicularly with fluid entry means 11 which is defined by straight connecting tube 13. The straight tube 13 includes a threaded connection 15, as shown in FIG. 2, for accepting a conventional male hose fitting (not shown) for purposes of connecting fluid passage means 9, via fluid entry means 11, with a source of fluid under pressure. The straight tube 13 further includes a conventional unitary quarter-turn ball valve 17 with associated lever 19 for regulating the flow of pressurized fluid.

Communicating with fluid passage means 9 is fluid outlet means 21, comprising a plurality of orifices, also 21, disposed in a circular array 23 and found in face of toroidal tube 3 about the inner surface 7. The array 23 is formed such that its centerline is coincident with the centerline of the face of torus 3. Orifices 21 are disposed at an angle of disposition with respect to a stated reference line positioned within toroidal tube 3. This angle of disposition of orifices 21 is best understood with reference to FIG. 2 of the drawings.

With respect to the preferred embodiment 1 of the apparatus of this invention, a cleaning device for paint applicators, the fluid comprises water and the source of fluid under pressure comprises a conventional water source, such as a residential yard spigot.

With respect to the orientation of the apparatus of this invention as illustrated in FIG. 2 of the drawings, the horizontal center line 25 of the circular cross-section of toroidal tube 3 coincident with an orifice 21 is the reference line for the specified angle of disposition typically approximately 25 degrees of the orifice 21. At each pertinent position along circular array 23, an orifice is disposed with respect to the centerline 25 of its respective stated cross-section. That is, each orifice 21 is set normal to the circular cross-section of toroidal tube 3, inclined off the principal axis of toroidal symmetry such that liquid flowing under pressure (see line 27) from within the torus 3, through orifices 21, forms a conical array of liquid jets which converge to a point 33 on the toroidal axis 29. The focusing of a plurality of liquid jets into a hollow conical zone 35 which converges to a point 33, is the fluid-mechanical mechanism which causes the effectiveness of the invention. The hollow conical zone 35 becomes the zone of optimal cleaning and minimal splashing. It is by positioning the paint brush or roller to be cleaned within zone 35 and, after connecting the cleaning device to a source of fluid under pressure [not shown] and setting it in operation, moving the cleaning device principally along the axes of the brush or roller that optimal cleaning results. The jet streams exiting through orifices 21 manipulate brush bristles and roller mat by lifting and separating, causing a scrubbing action which forces liquid to penetrate the material deeply and agitate the material completely. This scrubbing action flushes paint and tends to loosen dried deposits to provide a clean and re-usable brush or roller.

In addition, flange 37 is disposed circumferentially around the outer surface 5 of toroidal tube 3, providing blade 39, positioned directly opposite straight tube 13, with angled forward edge 41. Serrations or notches 43 are positioned along flange 37 between blade 39 and straight tube 13 to scrape and loosen dried paint and other deposits from brushes or rollers which may not have been adequately cleaned at previous times of use.

It is intended that the scope of this preferred embodiment 1 of the instant invention not be limited to the aforesaid, but include cleaning devices whose associated cleaning fluid comprises any suitable liquid and the object to be treated comprises any object suitably cleaned by liquid.

It is thus seen that the cleaning device described herein provides a novel and effective apparatus and process for cleaning paint brushes and rollers. Further, the device of this invention is made of readily available light-weight materials, is easily manipulated and allows its user to conveniently monitor the cleaning process.

Figure 3:
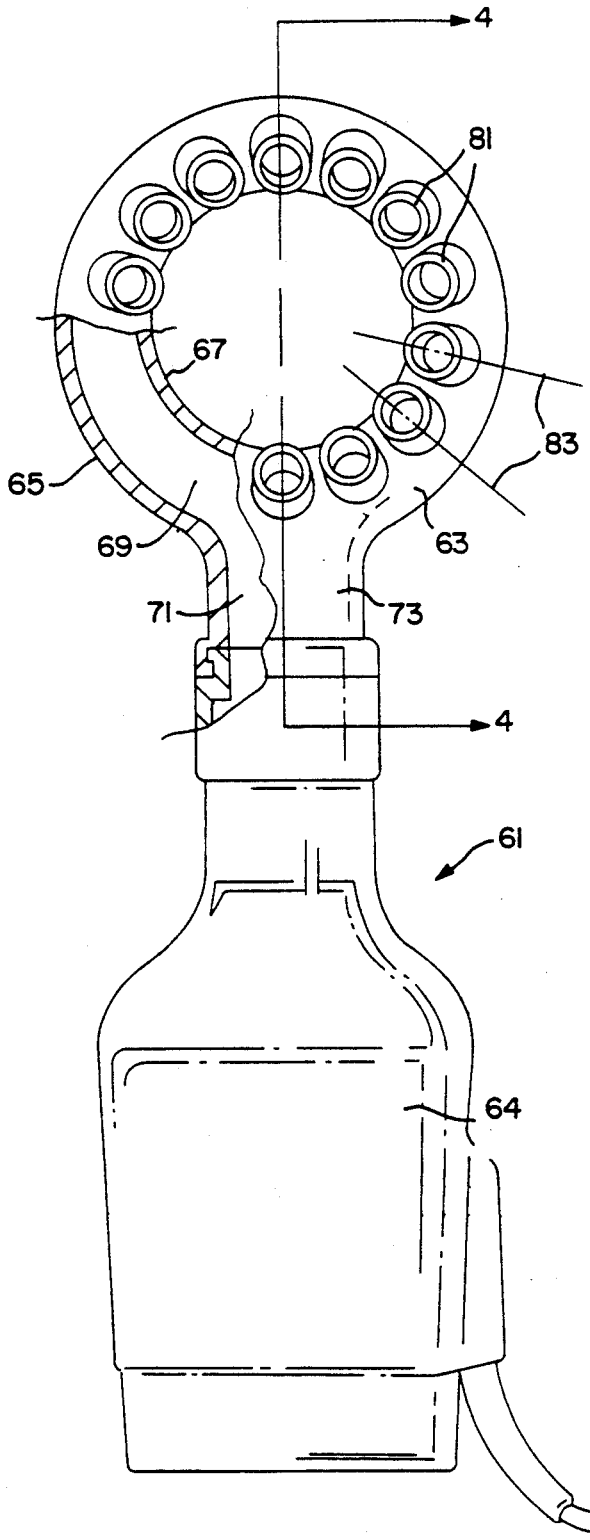
FIG. 3 of the drawings is a bottom view of a second preferred embodiment (hand-held hair drying device) of the apparatus in accordance with this invention showing the overall arrangement of the parts of the device and includes sectional views of the toroidal tube and straight connecting tube illustrating the fluid passage means connecting with the fluid entry means.

Illustrated in FIG. 3 of the drawings is another preferred form 61 of the apparatus of the instant invention, a hand-held hair drying device. The device includes a circular toroidal tube 63 having an outer surface 65 and an inner surface 67, and defining an annular fluid passage means 69 between the inner and outer surfaces of toroidal tube 63. Annular fluid passage means 69 connects perpendicularly with fluid entry means 71 which is defined by straight connecting tube 73.

Communicating with fluid passage means 69 is fluid outlet means 81, comprising a plurality of open-ended cylindrical nozzles, also 81. Cylindrical nozzles 81 are disposed in a circular array 83 and are formed in one face of toroidal tube 63 about the inner surface 67 at a specified angle of disposition with respect to a stated reference line positioned within the toroidal tube 63. This angle of disposition is best understood with reference to FIG. 4 of the drawings, and particularly with reference to the previously detailed discussion of angle of disposition in connection with the preferred embodiment 1 of this invention, the device for cleaning paint applicators. With respect to the preferred embodiment 2 of the apparatus of this invention, a hand-held hair drying device, the referenced fluid comprised heated air and the source of forced fluid comprises a conventional heater/blower assembly.

The circular array 83 of nozzles 81 is formed such that the centerline 89 of the array is coincident with the centerline 89 of the face of the torus 63. The nozzles 81 are set normal to the circular cross-section of the toroidal tube 63, but are inclined off the principal axes of toroidal symmetry such that air flowing under pressure (see line 87) from the source of forced air 64 through nozzles 81, forms a conical array of air jets which converges to a point 93 on the toroidal axis 89. The focusing of a plurality of air jets into a hollow conical zone 95 which converges to a point 93 is the fluid-mechanical mechanism which causes the effectiveness of apparatus 61.

The sourse of forced fluid associated with preferred embodiment 61 comprises a conventional heater/-blower assembly 64 which fits, hand in glove fashion, into straight connecting tube 73 for purposes of feeding forced heated air into fluid entry means 71, through fluid passage means 69, and out open-ended nozzles 81.

It is intended that the scope of this invention embodiment 61 of the instant invention not be limited to the aforesaid, but include hand-held drying devices whereby the associated fluid comprises heated air and the object to be treated comprises any object suitably dried by the apparatus.

Figure 4:
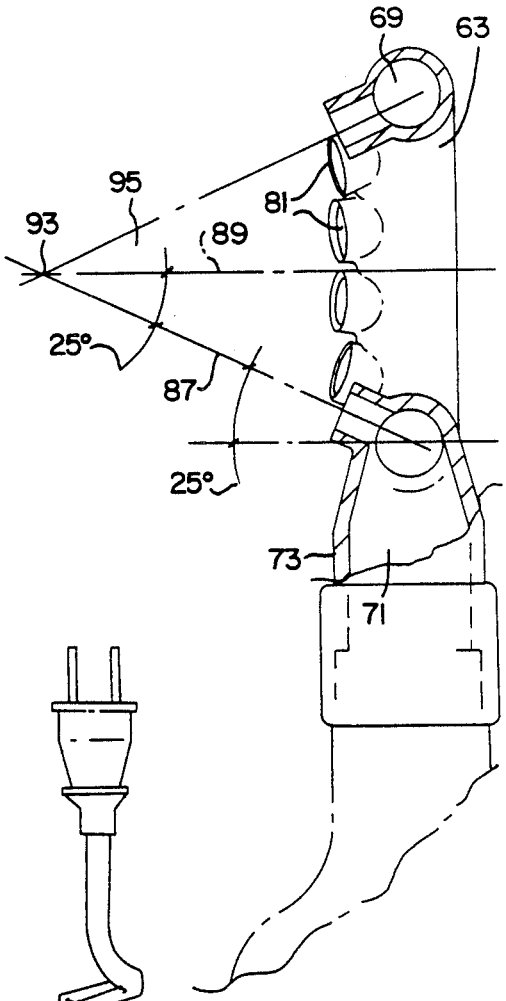
FIG. 4 of the drawings includes side views of the straight connecting tube and the associated heater/-blower assembly of a second preferred embodiment of the apparatus in accordance with this invention shown in FIG. 3, a longitudinal sectional view of the straight connecting tube and a cross-sectional view of the toroidal tube about the line 4—4 of FIG. 3.

The process of utilizing the embodiments of the apparatus in accordance with this invention is carried out by creating a focused flow of fluid 27 in (FIG. 2) and 87 (FIG. 4) in a predetermined direction and placing an object to be treated [not shown]between the focal point 33 (FIG. 2) and 93 (FIG. 4) of the focused flow and the source 21 (FIG. 2) and 81 (FIG. 4) of the flow for treatment by the fluid forced from the apparatus 1 (FIG. 2) and 61 (FIG. 4).

It is thus seen that the apparatus of this invention provides a novel apparatus which impinges a fluid upon an object to be treated. It is further seen that this invention provides a novel process, whereby a focused flow is created in a predetermined direction to treat with fluid therein an object between the focal point of the flow and the source of the flow. It is further seen that the process and apparatuses of this invention have other applications such as laundering, mixing, dying, etc. As many variations will be apparent to one of skill in the art from a reading of the above specification, such variations are within the spirit and scope of the instant invention as defined by the following appended claims.

That which is claimed:

1. A process for impinging a drying gas upon hair for the purpose of drying same, comprising the steps of:

providing a toroidal body having openings therein for projecting a drying gas therefrom, said toroidal body defining in the center thereof an orifice;

directing jets of a drying gas from said openings of said toroidal body to form a flow of drying gas, said jets focusing to form a hollow right circular cone of primary drying gas flow with the base of said cone being coincident with said jets of drying gas at said toroidal body and with the conical axis of said cone coinciding with the toroidal axis of said toroidal body;

positioning said toroidal body with respect to said hair such that said flow of drying gas striking the hair surface is reflected backwards toward said toroidal body and through said orifice; and said reflected flow of drying gas thereby causing said hair to be lifted toward said orifice.

2. A process for impinging a drying gas upon hair for the purpose of drying same, comprising the steps of:

directing jets of a drying gas from a generally circular array from a surface defining an unimpeded opening therethrough to form a generally conical flow of gases from said jets; and said flow of drying gases striking the hair surface at a point short of an apex of said cone and being reflected backwards turbulently through said opening and out into the ambient air thereby lifting the hair towards said opening.

3. A process for improved drying comprising the steps of:

(a) providing a tubular body having a generally circular array of fluid nozzles around an opening through said body, said nozzles being oriented to direct a stream of fluid toward a common point located away from said body;

(b) supplying drying fluid under pressure to said nozzles for forming a generally conical pattern of fluid flow from said nozzles; and (c) positioning said body with respect to an item to be dried such that the distance from said item and said body is less than the distance between said nozzles and said common point so that fluid from said nozzles reflects off said item to be dried and returns through said opening, creating enhanced drying conditions.

4. The process as defined in claim 3 wherein the item to be dried is provided with elongated flexible strands and wherein said fluid being reflected lifts said strands toward said opening.

5. The process as defined in claim 3 wherein the item to be dried is a head with hair thereon.

6. The process as defined in claim 3 wherein the drying fluid is heated air.

7. The process as defined in claim 3 comprising the further step of moving said body towards and away from said items to be dried.

8. An improved process for drying hair comprising the steps of:

(a) providing a tubular body having an opening therethrough with a generally circular array of nozzles around said opening, said nozzles being oriented to direct a stream of air towards a common point located outwardly therefrom;

(b) supplying air under pressure to said tubular body, said air passing through said nozzles and forming a generally conical pattern of air flow;

(c) positioning said body with respect to said hair to be dried such that the distance between said nozzles and said hair is less than the distance between said nozzles and said common point so that air reflects off said hair and returns through said opening while lifting hair towards said opening.

9. An improved process for drying hair comprising the steps of:

(a) generating a generally conical flow of air under pressure about an opening adjacent a base of the cone;

(b) locating hair to be dried between an apex of the cone and the base of the cone so that said air reflects off said hair and returns towards said base of said cone and through said opening, while lifting hair towards said opening.

* * * * *